United States Patent [19]

Schwartz

[11] 4,167,009

[45] Sep. 4, 1979

[54] RE-ENTRY CHAFF

[75] Inventor: Walter Schwartz, Northridge, Calif.

[73] Assignee: McDonnell Douglas Corporation, Long Beach, Calif.

[21] Appl. No.: 301,236

[22] Filed: Aug. 8, 1963

[51] Int. Cl.[2] ..... G01S 7/38; F42B 15/24

[52] U.S. Cl. ..... 343/18 B; 102/34.4; 102/63; 343/18 E

[58] Field of Search ..... 343/18, 5, 100, 18 B, 343/18 E; 102/34.4, 63

[56] References Cited

U.S. PATENT DOCUMENTS

| | | | |
|---|---|---|---|
| 2,881,425 | 4/1959 | Gregory | 343/18 B |
| 3,023,703 | 3/1962 | Beatty | 102/89 R |
| 3,068,472 | 12/1962 | Dell'Aria | 343/18 B |
| 3,095,814 | 6/1963 | Jansen et al. | 102/49.4 |
| 3,137,231 | 6/1964 | Johnson | 102/34.4 |
| 3,143,965 | 8/1964 | La Pointe | 102/34.4 |

*Primary Examiner*—Maynard R. Wilbur
*Assistant Examiner*—Richard E. Berger
*Attorney, Agent, or Firm*—Walter J. Jason; Donald L. Royer; John P. Scholl

EXEMPLARY CLAIM

4. A radar disabling means, including:
   a plurality of individual pieces of radar reflective chaff, each having a tear-drop shape.

6 Claims, 9 Drawing Figures

Fig. 6
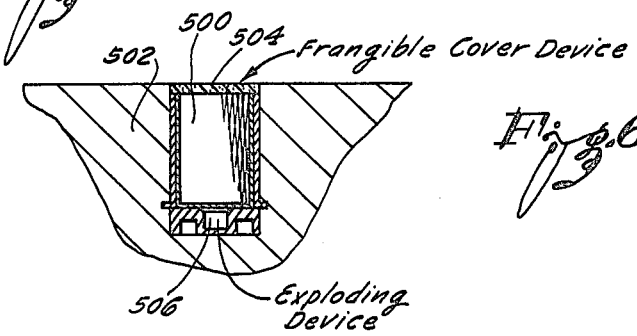
Fig. 6a
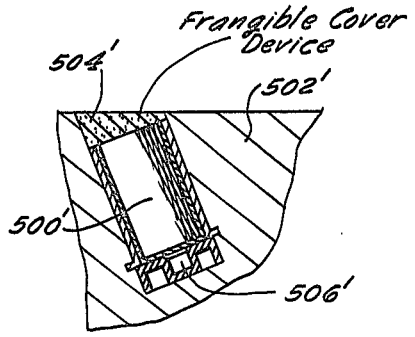
Fig. 3
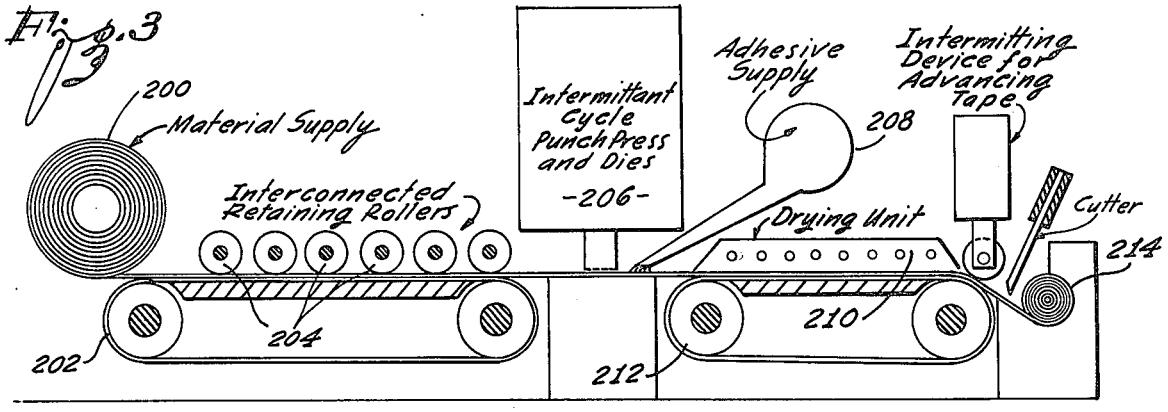
Fig. 2
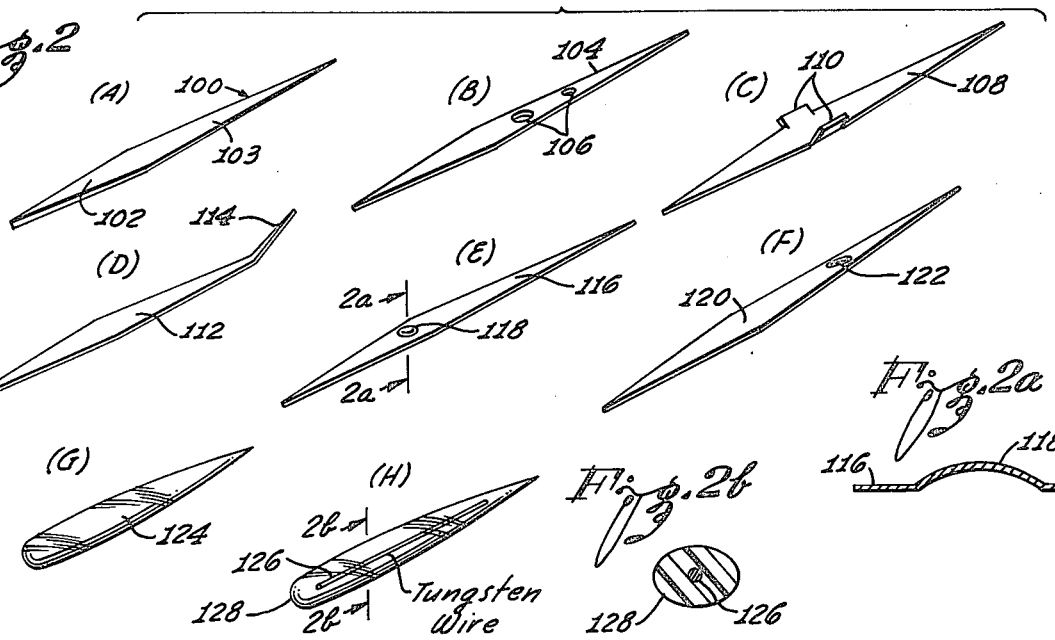
Fig. 2a
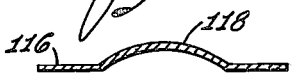
Fig. 2b

RE-ENTRY CHAFF

This invention relates to a chaff system which is able to survive the extremely penalizing environment of a long range ballistic missile trajectory. "Chaff" is the nomenclature that applies to a plurality of tuned radar reflector dipoles. These dipoles when serving as chaff are distributed profusely in such numbers so as to saturate the resolving elements of observing radar. This makes the radar unable to distinguish a target amongst the chaff cloud. This chaff system when part of a ballistic missile weapon system serves as a penetration aid, enhancing the penetrability of the warhead.

Chaff has a long history of successful operation as a penetration aid for manned bomber systems and it is known that theoretically it could also serve successfully with ballistic missiles if a material and technique could be found to survive the very stringent operational conditions imposed by the hypersonic re-entry conditions of ballistic missles. The type of material and configuration associated with bomber chaff would serve adequately outside of the earth's sensible atmosphere where there are no aerothermodynamic factors to be cosidered, but this material would be completely destroyed during early re-entry in the fringes of the atmosphere. This premature destruction of chaff would subject the ballistic missle warhead to early exposure and vulnerability to defensive action.

This invention has overcome the severe operational restraints of ballistic missle re-entry through judicious use of configurations and materials and will survive to very low altitudes.

In order for chaff to be effective as a ballistic missle penetration aid, it must have the following characteristics: First, the chaff must re-enter the atmosphere along with the re-entry vehicle and penetrate to very low altitudes. Second, the chaff must have a high ballistic coefficient so that the re-entry vehicle does not overrun the chaff material. Third, the chaff material must spread out over a relatively large area surrounding the re-entry vehicle to mask the exact location of the re-entry vehicle. Fourth, large numbers of the individual pieces of chaff must be capable of being packed in a relatively small volume and have a relatively small weight since volume and weight are a serious consideration in a ballistic missle. Finally, the chaff material must have good radar reflectivity.

There is unfortunately a conflict among the desired characteristics indicated above. For example, some types of chaff material have excellent radar reflectivity but these configurations generally have low ballistic coefficients and rapid slow-down characteristics. The slowing down can be solved by having re-entry cannisters follow the re-entry vehicle to a rather low altitude and then having the chaff dispersed at that point. However, this does not give a wide enough dispersion of the chaff material to sufficiently mask the location of the re-entry vehicle. The invention described herein discloses chaff configuration which has both aerodynamic and electromagnetic properties and which also lends itself to an excellent packaging form factors for high packing densities required for installation as part of a ballistic missle re-entry system.

The invention of the application solves the problems outlined above by designing the chaff material to operate as an aerodynamically stable dipole radar reflector. That is, the specific configuration of the dipole radar reflector is designed to have aerodynamic properties so that the dipole will re-enter the atmosphere. At some altitude, sufficient aerodynamic forces develop on the dipoles so that they begin to sail in erratic directions and subsequently become oriented across a radar beam. When this occurs, the dipoles become aligned with respect to the radar beam to provide good echoing characteristics. In order for the group of dipoles to operate as a good penetration aid, individual dipoles must sail at different altitudes so as to provide radar reflectivity over the entire re-entry path of the re-entry vehicle. This can be achieved by slightly varying the physical characteristics of the individual dipoles so that they have different aerodynamic characteristics.

The invention, therefore, contemplates a ballistic missile re-entry penetration system having a re-entry vehicle surrounded by a plurality of chaff material. The invention also contemplates a method of penetrating an enemy radar system by the use of aerodynamically stable radar reflective chaff material. The individual pieces of chaff material provide radar reflectivity since they are each designed as a dipole reflector. At any given altitude, some percentage of the total number of dipoles begin sailing and criss-crossing to become oriented across the enemy radar beams. Other dipoles continue in a ballistic trajectory until they begin sailing at a lower altitude. Therefore, a trough or corridor of radar reflectors is formed which surrounds the re-entry vehicle as the re-entry vehicle approaches the target area. This trough or corridor confuses the enemy radar sets as to the actual location of the re-entry vehicle. One solution for the dipole configuration is a flat, double-wedge design having one wedge longer than the other. This design pushes the center of gravity of the dipole forward toward the leading edge. Since it is aerodynamically desirable to have the center of gravity forward of the center of pressure, holes may be placed in the trailing edge of the dipole to shift the center of gravity even further forward without changing the center of pressure. Also, the leading edge of the dipole can have a greater thickness than the trailing edge to achieve the same result. Both of these techniques results in aerodynamically stable dipole chaff which operates as a re-entry device.

Dipoles of this nature can be manufactured by a simple punching operation from a sheet or roll of flat material. The dipoles can then be stacked or rolled into rectangular or cylindrical packages. The basic consideration is to obtain a maximum packing density for a low volume. The packages can be mounted either in the re-entry vehicle or in the booster missle to be ejected at some point during the flight of the ballistic missile. Various techniques may be used for separating the individual dipoles from the package. For example, the cylindrical package can be spun so that the individual dipoles are peeled off of the circumference of the package by centrifugal forces. Another method of separation would be to develop a mild explosive force to separate the individual dipoles.

A clearer understanding of the invention will be had with reference to the following figures, wherein:

FIG. 2 illustrates various forms (labeled A to H) that the individual dipoles may take;

Figure 4:
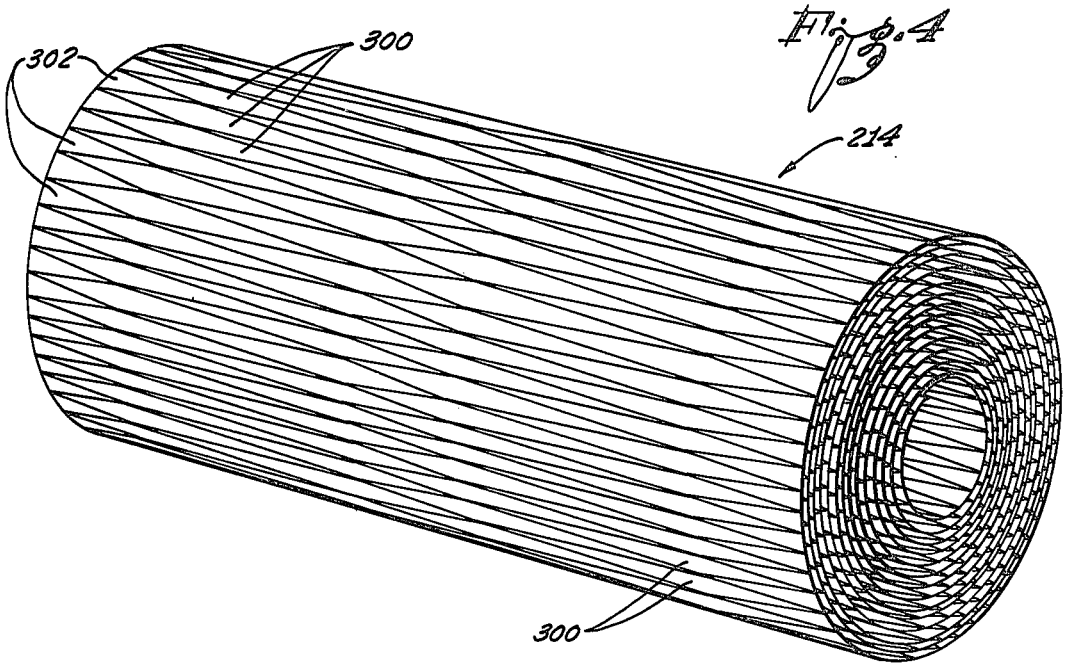
Figure 5:
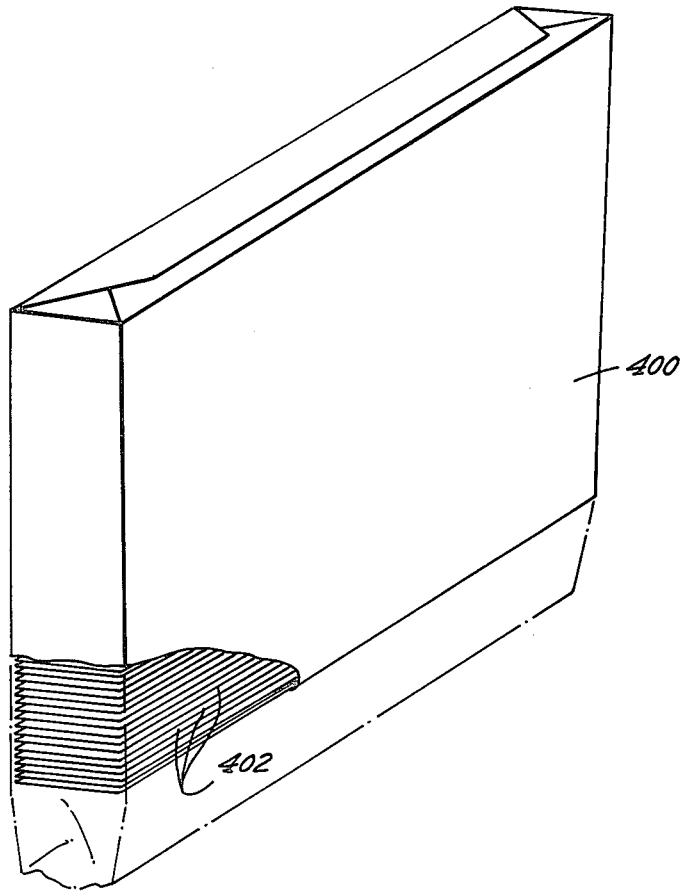

FIG. 2*a* is a cross-sectional view taken along line 2*a*—2*a* of dipole E shown in FIG. 2;

FIG. 2*b* is a cross-sectional view taken along line 2*b*—2*b* of dipole H shown in FIG. 2;

FIG. 3 illustrates a method which may be used for manufacturing a cylindrical package of dipoles;

FIG. 4 illustrates a plurality of dipoles packaged into a cylindrical shape;

FIG. 5 illustrates a plurality of dipoles packaged into a rectangular shape;

FIG. 6 illustrates one method of incorporating the package of dipoles in the missile booster; and FIG. 6*a* illustrates another method of incorporating the package of dipoles in the missile booster.

Figure 1:
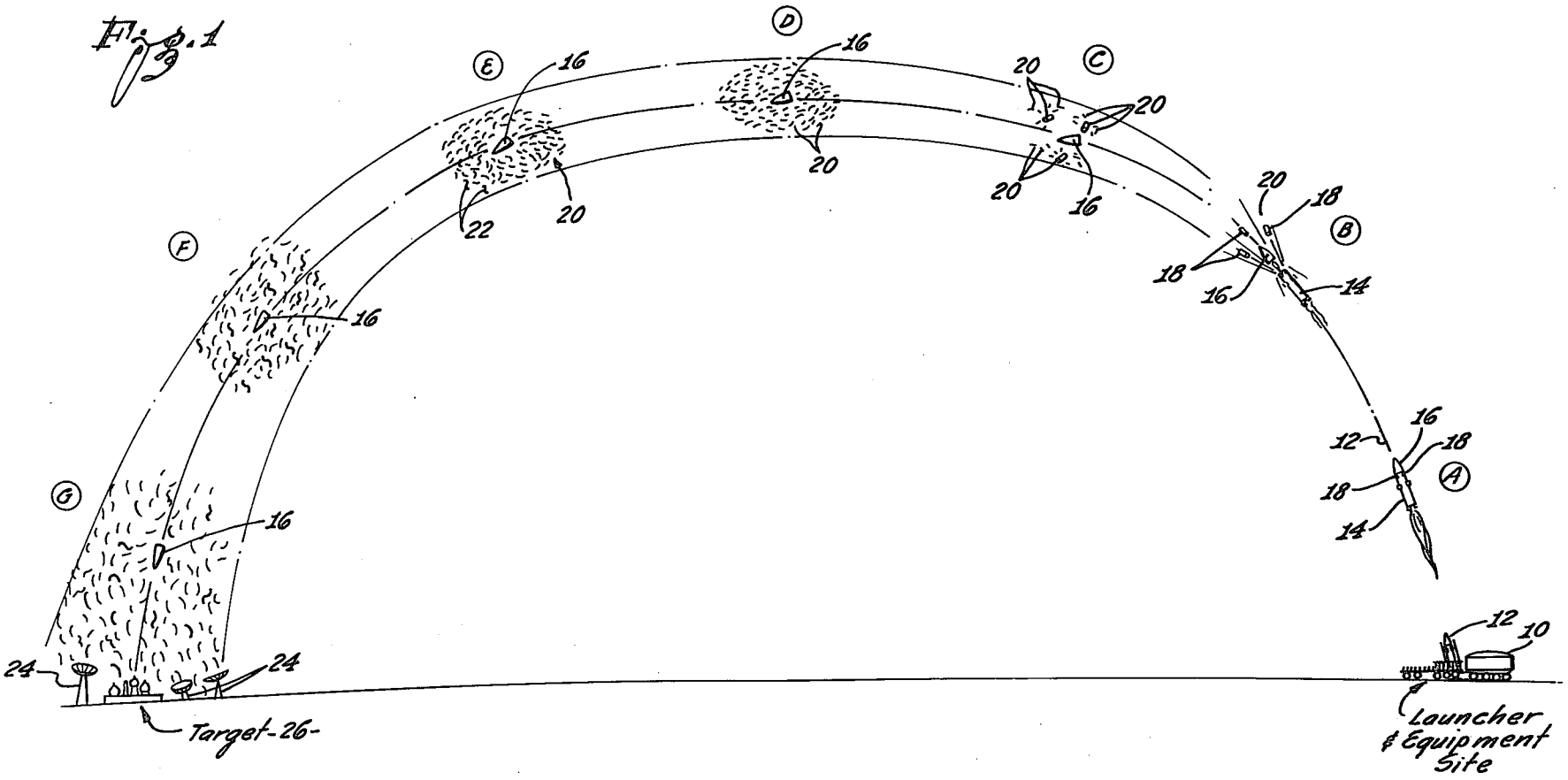
FIG. 1 illustrates a ballistic missile and re-entry vehicle at different points along a ballistic trajectory and illustrates the dispersion of the chaff material in relation to the re-entry vehicle at the different points.

In FIG. 1, a launching site 10 is used to launch a ballistic missile 12. As shown at position A in FIG. 1, the ballistic missile 12 includes a booster rocket 14 having a re-entry vehicle 16 mounted on top of the booster rocket. Incorporated in the front portion of the booster rocket 14 are a plurality of dipole chaff packages 18. At position B of FIG. 1 the booster rocket 14 is released from the re-entry vehicle 16. At the same time, the packages of chaff 18 are ejected from the booster rocket so as to follow along with the re-entry vehicle 16 on its flight path. The individual pieces of chaff 20 start to disperse from the packages 18 as soon as the packages are ejected. This is shown more clearly at position C of FIG. 1. By position D of FIG. 1, the re-entry vehicle 16 is shown surrounded by a cloud of chaff material 20. At this position, most of the chaff material 20 is oriented in a stable flight path so as to follow along with the re-entry vehicle.

At position E of FIG. 1, the re-entry vehicle starts its descent into the atmosphere. At this altitude, most of the chaff material 20 is still oriented in a stable flight path. However, some of the individual pieces of chaff, for example those shown in positions 22, start to encounter aerodynamic forces because of their design and begin to sail and criss-cross within the cloud of chaff. As the chaff 22 is undergoing its erratic flight, some of the chaff is oriented across the radar beams sent off by the radar stations 24 located near the target area 26. The actual position of the re-entry vehicle 16 is therefore hidden within the cloud of chaff. As the re-entry vehicle 16 penetrates deeper into the atmosphere as shown in position F of FIG. 1, others of the individual pieces of chaff material encounter aerodynamic forces and maneuver into positions to operate as radar reflectors. This continues to hide the position of the re-entry vehicle. Finally, as the re-entry vehicle 16 is almost at the target area, as shown at position G in FIG. 1, the re-entry vehicle 16 is completely surrounded by chaff operating as radar reflectors so that the actual location of the re-entry vehicle is masked.

It can, therefore, be seen that at some high altitude individual ones of the chaff material operate as radar reflectors. Therefore, for a major portion of the flight path of the re-entry vehicle, some of the chaff material is operating to confuse the enemy radar.

As long as there are a sufficient number of dipoles throughout the major portion of the flight path of the re-entry vehicle, the defense radar is saturated so that the location of the re-entry vehicle is never determined by the radar station. The defense radar may be saturated if the energy received in the spatial-doppler resolution cells are sufficient to cause blips in a large number of these resolution cells. Even if the resolution cells are not solidly occupied, the ability of the radar to correlate blips on successive scans to perform trajectory predictions and to perform discrimination based on range radar acceleration may be saturated provided a sufficient percentage of the resolution cells are occupied. The reflected energy from chaff which enters a given spacial-doppler resolution cell may arise not only from chaff which physically occupies that cell, but also because of the ambiguities of the radar waveform in the time frequency plane. It may arise from chaff in other resolution cells which may thereby contribute to the energy which appears in any one cell. Therefore, even a relatively small surviving percentage of the total number of original chaff dipoles would continue to be effective in saturating the defense radars.

FIG. 2, embodiments A to H, inclusive, illustrate various forms and variations that the individual chaff dipoles may take. For example, in embodiment A, a dipole 100 may generally take a double wedge form with the smaller wedge 102 forming the leading edge and with the larger wedge 103 forming the trailing edge. The dipole is constructed in this manner since it is aerodynamically desirable to maintain the center of gravity of the dipole forward of the midpoint. The slender configuration is also chosen for its inherent low drag characteristics and consequent high ballistic coefficient. Maintenance of a relatively high ballistic coefficient assures a velocity profile for a considerable distance into the atmosphere, approximately that of the re-entry vehicle. Thus, the re-entry vehicle would not outrun the chaff. The dipole illustrated as embodiment A of FIG. 2 is tapered by having its thickness at the leaading edge greater than the thickness at the trailing edge. This moves the center of gravity forward of the center of pressure, insuring a positive stability in the dipole.

Embodiment B of FIG. 2 shows a dipole similar to the one illustrated as embodiment A; however, embodiment B has a uniform thickness throughout. In order to maintain a positive stability in the dipole 104, it is again necessary to have the center of gravity forward of the center of pressure. This is accomplished by the use of lightening holes 106. These holes change the center of gravity but do not change the center of pressure of the dipole at hypersonic speeds. Embodiments C to F, inclusive, illustrate variations that may be incorporated within either of the embodiments A and B for varying the angle of attack that the dipole is stabilized at during flight. The angle of attack for individual dipoles determines the altitude at which individual dipoles will sail and criss-cross. The variations in the angle of attack are achieved by incorporating small perturbations in the dipoles.

For example, in embodiment C, a dipole 108 has bent-up portions 110. The angle of bending and the amount of material which is bent at the sides of the dipole can be varied to vary the angle of attack. In embodiment D, a dipole 112 has a bent-up flap 114. The angle of attack can be varied by varying the size and angle of the flap section 114.

Embodiment E illustrates another method of varying the angle of attack of an individual dipole. In embodiment E, a dipole 116 has a dimple 118 located in the forward portion of the dipole. The dimple 118 can be seen more clearly in FIG. 2*a*. Embodiment F illustrates a dipole 120 having a dimple 122 located in the aft portion of the dipole. In both of the embodiments E and F, the exact size, shape and location of the dimple may be varied to change the angle of attack of individual dipoles.

Embodiment G illustrates a dipole 124 which has a teardrop shape. it is to be appreciated that variations in the exact shape and outward configuration of the dipole 124 may be incorporated so as to provide the individual variations necessary to achieve different angles of attack for different dipoles. Structures similar to those shown in embodiments C to F, inclusive, may be utilized to achieve the individual results desired. All of the dipoles illustrated in embodiments A through G are made of a material having a high melting point. For example, tungsten which has a melting point of 3,000° C. could be used in the manufacture of the dipoles. Using a material having a high melting point allows the dipoles to re-enter the atmosphere without being consumed.

Embodiment H shows a dipole which uses a different principle of re-entry. An inner wire 126 operates as the dipole radar reflector and the wire is therefore made of a material which reflects radar signals. Surrounding the wire is a coating of dielectric material 128 which can be formed into an aerodynamic shape. The shape of the dielectric material 128 is shown to be similar to the tear-drop shape of the dipole 124 illustrated in embodiment G, but it will be appreciated that other shapes may be used. The dielectric material may be composed of ceramic, quartz, teflon, or any other material which sublimes as it is heated. The evaporation effectively cools the inside portion of the dipole. This allows the dipole wire 126 to re-enter the atmosphere without being consumed.

The dipoles shown in embodiments A to F, inclusive, are essentially flat plates, and at hypersonic speeds, the center of pressure of these dipoles is considered to be at the centroid of the planform area. The center of gravity of a uniformly thick homogeneous material also is at the centroid of the planform area. Since both the center of pressure and the center of gravity are located at the same place, the dipole has no stability. This can be corrected by moving the center of gravity forward of the center of pressure. One method of achieving this result is shown in embodiment B of FIG. 2. The holes 106 cause the center of gravity to move forward while at hypersonic speeds the holes do not cause a corresponding shift in the center of pressure. The same effect is achieved by the tapered dipole shown by embodiment A in FIG. 2. The tear-drop shaped dipoles illustrated in embodiments G and H also have the center of pressure behind the center of gravity. All of these designs insure a positive stability in the dipoles so as to allow the dipoles to re-enter the atmosphere.

Another important consideration in the design of the dipoles is the angle of attack the dipole assumes as it enters the atmosphere. A dipole stabilized at a zero angle attack penetrates to a very low altitude. However, the effectiveness of a dipole as a radar reflector depends upon its achieving an orientation of its longitudinal axis away from the axis of the radar beam. It is, therefore, necessary that the dipoles have varying angles of attack so that effective radar reflectivity is achieved during most of the flight path of the re-entry vehicle.

For example, dipoles stabilized at high angles of attack will experience increasing lift forces relatively early during re-entry and as the dipole continues to re-enter the lift forces will cause dipole excursions away from the ballistic path so that eventually the aerodynamic sailing occurs. For dipoles stabilized at smaller angles of attack this same experience occurs but at lower altitudes. It is apparent that an appropriate mix of dipoles with built-in asymmetrics causes various angles of attack and the dipoles will sail throughout a deep corridor surrounding the re-entry vehicle. It is also to be noted that since the dipole is not necessarily stabilized around its longitudinal axis, that is, it does not have built-in lateral stability, the dipole could at any time whip over and reverse the direction of acceleration causing the dipole to sail back and forth in an erratic manner.

FIG. 3 illustrates a method of manufacturing the dipoles in a convenient cylindrical package. A roll of flat sheet material 200 is moved in a longitudinal direction by a roller mechanism consisting of a belt-drive 202 and a plurality of retaining rollers 204. The material is moved under an intermittent punch press 206 which stamps out the dipole shapes in the material. At this point, the individual dipoles are lying next to each other in a fixed pattern. An adhesive is applied as a coating to connect the dipoles to each other only for the handling required during the manufacturing process. The adhesive is supplied by a means 208. The dipoles are then moved under a drying unit 210 by a belt 212. The adhesive material is dried to form an integral sheet of individual dipoles bonded together by adhesive material. The sheet of dipoles is then rolled up into a cylindrical package 214.

The package of dipoles 214 is illustrated in FIG. 4. It will be noted that individual dipoles 300 are intermixed to utilize the maximum area of the sheet material. However, even end portions 302 are not wasted since these portions also operate as dipoles for higher frequency radar signals. Another method of packaging the dipoles is illustrated in FIG. 5. The package 400 contains sheets of dipoles stacked on top of each other to form a rectangular shape. Although the dipoles have been shown to be all the same size, it will be appreciated that the dipoles may have different sizes. This would give a broader frequency average. The intermixture of sizes may be within a single package or the different packages may have different sizes.

After the packages of dipoles have been formed, as shown in FIGS. 4 and 5, the packages may be heated so that the adhesive material is evaporated. In this way, the dipoles are left in a separated condition so as to easily separate when the entire package is ejected into space. Alternatively, the adhesive material may be left and when the package of dipoles is ejected into the vacuum of space, the adhesive material would evaporate to free the dipoles.

As illustrated in FIG. 1, the packages of dipoles are disposed within the space booster at positions 18. This can be seen more clearly in FIG. 6 which shows a package of dipoles 500 contained within an opening in the booster 502. A frangible cover 504 seals the package in position. An explosive charge 506 is used to eject the package of dipoles at the appropriate time during the flight of the ballistic missile. If the package to be used has a cylindrical shape as shown in FIG. 4, the entire package can be made to spin after it is ejected by the application of appropriate forces during ejection. The rotation of the package causes centrifugal force to be developed on the outside surface of the cylinder. The centrifugal force peels the dipoles off the outside surface of the package. Another method of separating the dipoles after the ejection of the dipole packages is to include a highly voluble material such as alcohol within the package. When the package of dipoles is ejected into the low vacuum of a space atmosphere, the voluble material rapidly evaporates to cause propulsive forces which disperse the dipoles in various directions.

FIG. 6*a* illustrates another method of mounting the package of dipoles in a booster rocket. The elements of FIG. 6*a* are similar to the elements of FIG. 6 and the reference characters are differentiated by the addition of a prime symbol. In FIG. 6*a* the package of dipoles 500′ is mounted at an angle within the booster rocket 502′. By appropriately mixing the angles for the different packages contained in the booster rocket, the packages may be ejected in different directions to surround the re-entry vehicle.

It is to be realized that although this invention has been disclosed with reference to particular embodiments, these embodiments are illustrative only. For example, wedges, cones and other aerodynamic shapes may be used to make the dipoles. Also, the invention has been disclosed showing the ejection of the packages of dipoles at a particular time during flight of the ballistic missile. It will be appreciated that the package of dipoles may be mounted on the re-entry vehicle itself and that the ejection of the dipoles could take place at a later time in the flight path. It is also to be understood that other methods of ejecting the package of dipoles may be used. Finally, the specific method of manufacturing the flat dipoles as shown in FIG. 3 is illustrative only and many other methods may be used to manufacture and package the dipoles. The invention, therefore, is only to be limited by the appended claims.

What is claimed is:

1. A radar disabling means, including:

flat radar reflective chaff material having a leading portion and a trailing portion and with the leading and trailing portions both triangularly shaped and with the leading portion having a smaller area than the trailing portion.

2. The chaff means of claim 1, wherein:

the leading portion has a greater average thickness than the trailing portion.

3. The chaff means of claim 1, wherein:

the trailing portion includes lightening holes.

4. A radar disabling means, including:

a plurality of individual pieces of radar reflective chaff, each having a tear-drop shape.

5. A method of aiding the penetration of a radar defense system protecting a target area by a ballistic missile, including the steps of:

launching the ballistic missile by a booster rocket, ejecting aerodynamically stable radar reflecting chaff from the ballistic missile during the flight of the ballistic missile, forming a cloud of chaff surrounding the ballistic missile during the flight of the ballistic missile, and orienting individual pieces of chaff to reflect radar signals from the radar defense system during a major portion of the flight path of the ballistic missile to mask the location of the ballistic missile until it strikes the target area.

6. The method of claim 5, including the step of:

forming perturbations in individual ones of the chaff to produce aerodynamic forces on the chaff at different altitudes to orient the chaff for reflection of the radar signals at the different altitudes.

* * * * *